US008324488B2

(12) United States Patent
Iwamoto et al.

(10) Patent No.: US 8,324,488 B2
(45) Date of Patent: Dec. 4, 2012

(54) PEDAL APPARATUS OF AN ELECTRONIC MUSICAL INSTRUMENT

(75) Inventors: Toshiyuki Iwamoto, Hamamatsu (JP); Kenichi Nishida, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/880,822

(22) Filed: Sep. 13, 2010

(65) Prior Publication Data

US 2011/0061518 A1 Mar. 17, 2011

(30) Foreign Application Priority Data

Sep. 15, 2009 (JP) ..... 2009-212827
Jun. 30, 2010 (JP) ..... 2010-149503
Jun. 30, 2010 (JP) ..... 2010-149504

(51) Int. Cl.
*G10D 3/16* (2006.01)

(52) U.S. Cl. ..... 84/225

(58) Field of Classification Search ..... 84/225–233, 84/422.1, 422.2, 422.3
See application file for complete search history.

(56) References Cited

U.S. PATENT DOCUMENTS 4,235,146 A * 11/1980 Purdy ..... 84/422.1
7,470,847 B2 12/2008 Kitagawa

FOREIGN PATENT DOCUMENTS

JP 6-011000 U 2/1994
JP 2001-022355 A 1/2001
JP 2004-334008 A 11/2004
JP 2008-145464 A 6/2008
JP 2009-128767 A 6/2009
JP 2009-128768 A 6/2009
JP 2009-192719 A 8/2009
JP 2009-258644 A 11/2009

* cited by examiner

*Primary Examiner* — Kimberly Lockett

(74) *Attorney, Agent, or Firm* — Rossi, Kimms & McDowell LLP

(57) ABSTRACT

A lever 1 pivots within a certain stroke range by a player's depression of the lever 1. A coil spring 4 is displaceable within the entire stroke range of the lever 1 to produce a reaction force having a characteristic that the reaction force increases with an increase in the displacement. A dome-shaped rubber member 5 starts being displaced at some point in the stroke of the lever 1 to produce a reaction force having a characteristic that the rate of change in reaction force with respect to the displacement decreases in an area placed in the displacement. The characteristic is obtained by the dome-shaped rubber member 5 coming into contact with the lever 1 at some point in the stroke of the lever 1 to start being displaced by further depression of the lever 1 to buckle at some point in the displacement of the dome-shaped rubber member 5.

10 Claims, 6 Drawing Sheets

PEDAL APPARATUS OF AN ELECTRONIC MUSICAL INSTRUMENT

BACKGROUND OF THE INVENTION

1. Field of the Invention

The present invention relates to a pedal apparatus of an electronic musical instrument, the pedal apparatus having characteristics of reaction force similar to those of a pedal of an acoustic piano.

2. Description of the Related Art

As for an acoustic piano which is a natural musical instrument, particularly, a grand piano, when a player of the acoustic piano depresses a damper pedal, the player recognizes the gradient of reaction force imposed by the damper pedal. That is, the player recognizes that the rate of change in reaction force (increment value of reaction force divided by increment value of the amount of stroke) varies according to the depth of depression of the damper pedal (stroke). FIG. 5 indicates an overview of characteristics of reaction force of a lever (a damper pedal or a shift pedal) of a grand piano. The vertical axis indicates the load applied to the lever, while the horizontal axis indicates the amount of displacement (the amount of stroke) of the lever. A characteristic curve 61 indicates the amount of stroke of the damper pedal to which the load is applied. The load is perceived by the player as a reaction force when the player depresses the damper pedal.

The damper pedal is connected to dampers through some connecting portions. In an initial state where the player starts depressing the damper pedal, respective weights of the dampers and the connecting portions contribute to production of an initial reaction force, resulting in a great rate of change in reaction force. Then, while the amount of stroke of the damper pedal is small, the force exerted by the player to depress the damper pedal will not be conveyed to the dampers because of interstices of the connecting portions. While the amount of stroke of the damper pedal falls within a shown area A0, therefore, the rate of change in reaction force is small except the initial state. If the player increases the amount of stroke of the damper pedal further, the amount of stroke enters a shown area A1 where the force exerted by the player in order to depress the damper pedal is conveyed to the dampers through the connecting portions to start lifting the dampers which are in contact with strings. Because of elastic elements which the respective connecting portions have and increased friction produced by uneven moves of the neighboring dampers, in the area A1, the rate of change in reaction force increases. When the amount of displacement of the damper pedal increases further to enter an area A2, all the dampers fully leave the strings to stop the increase in the reaction force caused by the elastic elements which the respective connecting portions have. In the area A2, as a result, the rate of change in reaction force of the damper pedal decreases again. When the amount of stroke then enters an area A3, the damper pedal comes into contact with a stopper, resulting in a sharp increase in the rate of change in reaction force.

A shown area AH (an area ranging from the latter half of the area A1 to the neighborhood of the boundary between the areas A1, A2) is generally referred to as a half pedal area. Advanced players subtly change the amount of depression of the damper pedal in the half pedal area AH to change the timbre, reverberation and the like of musical tones to be generated. By recognizing varying rates of change in reaction force in the boundary between the area A1 and the area A2, the advanced players realizes that the amount of stroke of the damper pedal is in the half pedal area. Depending on the types and manufacturers of grand pianos, respective structures of the damper pedal, the connecting portions and the dampers vary. Therefore, respective start positions and respective widths of the shown areas A0, A1, AH, A2 vary among grand pianos. Some grand pianos have characteristics, as indicated by a characteristic line 62 indicated by a dashed line, that there is no difference in the rate of change in reaction force between the areas A0, A1.

The grand piano also has a shift pedal. In response to the player's depression of the shift pedal, a mechanism for striking the strings moves in the direction in which keys of a keyboard are arranged. As a result, one of two or three strings provided for each key will not be struck by a hammer. The shift pedal exhibits characteristics of reaction force similar to those of the above-described damper pedal indicated by the characteristic curve 61. In the area A0, however, the shift pedal exhibits the characteristics indicated in the figure by the characteristic curve 62 of the dashed line. The characteristic curve 61 indicates the characteristics exhibited when the damper pedal is depressed. A characteristic curve exhibited when the damper pedal is released indicates that the reaction force of the released damper pedal is slightly smaller than that of the depressed damper pedal with respect to the same amount of displacement of the damper pedal. The difference in the reaction force between the depressed damper pedal and the released damper pedal is caused by hysteresis produced by viscosity and friction forces of the connecting portions. The shift pedal exhibits a larger hysteresis than the damper pedal.

In general, conventional pedal apparatuses of electronic musical instruments are designed such that a damper pedal is urged by one spring. As a result, the gradient of reaction force does not change. However, there is a known art applied to a pedal apparatus of an electronic musical instrument in order to vary the rate of change in reaction force exerted by a damper pedal according to the amount of stroke of the damper pedal (Japanese Unexamined Patent Publication No. 2004-334008). The disclosed art employs two spring members so that the spring members can act on a damper pedal step by step. The art exhibits characteristics in which the reaction force starts increasing at some point during the stroke of the damper pedal. However, the characteristics exhibited by the disclosed art provide the player with a sense of touch which is different from that offered by the damper pedal of the grand piano indicated in FIG. 5. In addition, the damper pedal of the conventional art requires the player to apply a greater force in order to fully depress the damper pedal than that required when the player fully depresses the damper pedal of the grand piano.

SUMMARY OF THE INVENTION

The present invention was accomplished to solve the above-described problems, and an object thereof is to provide a pedal apparatus of an electronic musical instrument, the pedal apparatus realizing, with a simple structure, characteristics of reaction force similar to those of a pedal (a damper pedal or a shift pedal) of a grand piano.

In order to achieve the above-described object, it is a feature of the present invention to provide a pedal apparatus of an electronic musical instrument, the pedal apparatus including a lever which pivots within a certain stroke range by a player's depression of the lever; a first urging element which is displaceable within the entire range of stroke of the lever to produce a reaction force which increases with an increase in the displacement of the first urging element to exert the produced reaction force on the lever; and a second urging element which starts being displaced at the start or at some point in the stroke of the lever to produce a reaction force having a characteristic that rate of change in the reaction force with respect to the displacement of the second urging element decreases in an area placed at some point in the displacement to exert the produced reaction force on the lever. In this case, the first urging element is a metallic spring, for example. The second urging element is an elastic member, which is different from the first urging element, such as an elastic member whose material is rubber, for example. In response to a depression of a pedal, as a result, the reaction force which increases with an increase in the stroke is produced from the start of the stroke, whereas the reaction force has the area in the stroke where the rate of change in the reaction force with respect to the stroke of the pedal decreases. Therefore, the pedal apparatus of the electronic musical instrument realizes with the simple structure, characteristics of reaction force of a damper pedal or a shift pedal of a grand piano.

It is another feature of the present invention that the reaction force produced by the second urging element has an area in which the reaction force varies at a negative rate of change with an increase in the displacement. Consequently, the pedal apparatus is able to significantly decrease the rate of change in the reaction force of the lever at some point in the displacement, facilitating player's recognition of the half pedal area.

It is still another feature of the present invention that the reaction force produced by the second urging element varies at all times at a positive rate of change with an increase in the displacement. Consequently, the pedal apparatus increases durability of the second urging element, also stabilizing the movement of the second urging element.

It is a further feature of the present invention that the second urging element produces the reaction force having the characteristic by starting buckling at some point in the displacement of the second urging element. By starting buckling at some point in the displacement, therefore, the rate of change in the reaction force with respect to the increase in the amount of stroke of the pedal decreases in the area of the stroke.

It is still a further feature of the present invention that the second urging element is an elastic member shaped like a dome. By the simple material, shape and structure, therefore, the second urging element is able to buckle to be deformed at some point in the displacement of the second urging element.

It is another feature of the present invention that the pedal apparatus further includes a first switch which turns on when the rate of change in the reaction force produced by the second urging element increases most significantly during the increasing displacement of the second urging element. Consequently, the position of the lever at which the rate of change in the reaction force increases most significantly can be defined as the lowest position of the half pedal area.

It is still another feature of the present invention that the pedal apparatus further includes a second switch for detecting the displacement of the second urging element, the second switch turning on when the rate of change in the reaction force produced by the second urging element decreases most significantly during the increasing displacement of the second urging element. Consequently, the position of the lever at which the rate of change in the reaction force decreases most significantly can be defined as the highest position of the half pedal area.

It is a further feature of the present invention that the second urging element comes into contact with the lever at some point in the stroke of the lever so that the second urging element can be displaced by further depression of the lever. Because the second urging element starts being displaced at some point in the stroke of the lever, the rate of change in the reaction force with respect to the increase in the amount of stroke of the pedal temporarily increases at some point in the stroke of the lever, and then decreases again. By the simple structure, therefore, the pedal apparatus of the electronic musical instrument is able to realize the characteristics of the reaction force of a damper pedal of a grand piano of the type in which the rate of change in the reaction force temporarily increases at some point in the stroke of a lever.

The present invention described above realizes with the simple structure, the characteristics of reaction force of a pedal (a damper pedal or a shift pedal) of a grand piano. Therefore, the pedal apparatus of the electronic musical instrument according to the present invention facilitates player's pedal manipulation in the half pedal area, offering the player easy control of musical tones on the electronic musical instrument.

DESCRIPTION OF THE PREFERRED EMBODIMENT

Figure 1:
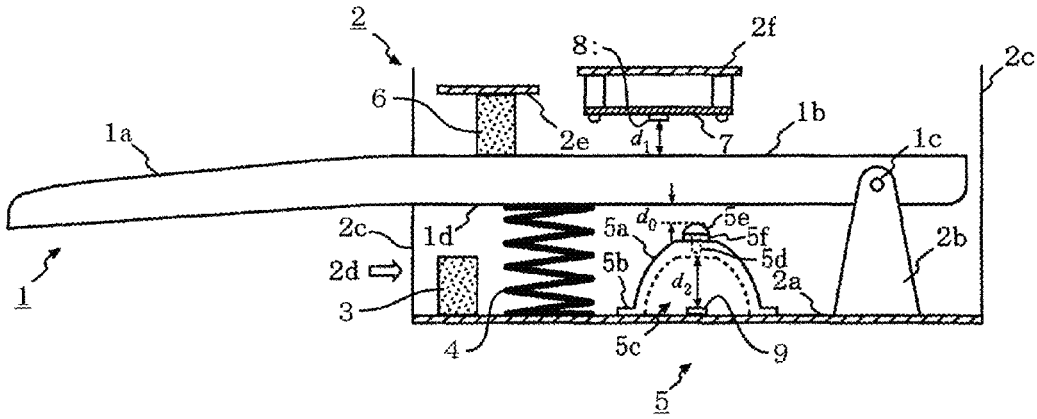
FIG. 1 is a side view of a pedal apparatus of an embodiment of the present invention.

FIG. 1 is an explanatory drawing indicative of an embodiment of the present invention. More specifically, FIG. 1 indicates a vertical cross-section of a side face of a pedal apparatus. The pedal apparatus has a lever 1 (a damper pedal or a shift pedal) and a pedal frame 2. The pedal frame 2 supportively fixes not only the lever 1 but also a coil spring 4, a dome-shaped rubber member 5, a lower limit stopper 3, an upper limit stopper 6, a first sensor 8, a second sensor 9 and the like which will be described in detail later. The pedal frame 2 is fixedly coupled to a main body of an electronic keyboard instrument through a leg which is not shown, or serves as a base of the electronic keyboard instrument.

The lever 1 has a lever operating portion 1*a*, an upper surface 1*b*, a fulcrum 1*c* and a lower surface 1*d*. On an upper surface of a bottom plate 2*a* of the pedal frame 2, a lever supporting portion 2*b* is provided. The lever operating portion 1*a* juts from a front opening 2*d* surrounded with the bottom plate 2*a* and right and left side plates 2*c* (the left side plate seen from a player is indicated in this figure) of the pedal frame 2. The lever 1 is designed such that the fulcrum 1*c* is supported by the lever supporting portion 2*b* so that the lever 1 can pivot within a certain stroke range by a player's depression of the lever operating portion 1*a*. The shown lever 1, which is shaped like an approximately rectangular parallelepiped square bar, has the lower surface 1*d*. Instead of this design, the lever 1 may be designed to have the upper surface 1*b* and right and left side surfaces to have a concave portion which opens downward.

On the bottom plate 2*a* of the pedal frame 2, the lower limit stopper 3 is erected to be situated near the front opening 2*d*. The lower limit stopper 3, which is made of felt, for example, restricts, along with the later-described upper limit stopper 6, the stroke range of the lever 1 which pivots in response to the player's depression of the lever 1. Between the lower limit stopper 3 and the lever supporting portion 2*b*, the coil spring (a first urging element) 4 and the dome-shaped rubber member (a second urging element) 5 are erected along the lever 1. The coil spring 4 and the dome-shaped rubber member 5 may be arranged in reverse order.

The coil spring 4 can be displaced within the entire stroke range of the lever 1, generating a reaction force roughly proportional to the displacement of the coil spring 4. In other words, the reaction force exerted by the coil spring 4 increases with an increase in displacement of the coil spring 4. The dome-shaped rubber member 5 comes into contact with the lever 1 at some point during the stroke of the lever 1. When the lever 1 is depressed further, the dome-shaped rubber member 5 starts being displaced. At some point during the displacement of the dome-shaped rubber member 5, the dome-shaped rubber member 5 starts buckling to be deformed. Therefore, the dome-shaped rubber member 5 has characteristics that the dome-shaped rubber member 5 starts being displaced at some point during the stroke of the lever 1, with the rate of change in the reaction force with respect to the displacement of the dome-shaped rubber member 5 decreasing in a certain area during the displacement of the dome-shaped rubber member 5.

The dome-shaped rubber member 5 has a bending portion 5*a* and a flat base portion 5*b* situated around a lower part of the bending portion 5*a*. The base portion 5*b* is fixedly coupled to the bottom plate 2*a* of the pedal frame 2. The bending portion 5*a* and the bottom plate 2*a* form an inner space 5*c*. The bending portion 5*a*, which is shaped like a semi-round, semi-oval round, frustum of a cone, circular cylinder or the like, has a hollow portion. On the side surface of the base portion 5*b* and/or the bottom plate 2*a*, air vents which are not shown are provided to allow the inflow and outflow of air between the inner space 5*c* and outside air through the air vents when the bending portion 5*a* is deformed or recovers to its original shape.

The top of the head of the dome-shaped rubber member 5 serves as a driven portion facing the lower surface 1*d* of the lever 1. On the flat upper portion of the bending portion 5*a*, in the shown example, a screw hole 5*d* is provided. By tightening a screw 5*e* into which a spacer 5*f* is fit into the screw hole 5*d*, the head of the screw 5*e* serves as the above-described top of the head of the dome-shaped rubber member 5. In an initial state of the lever 1 (in a state where the lever 1 is not being depressed), the screw 5*e*, that is, the top of the head of the dome-shaped rubber member 5 is placed to face the lower surface 1*d* of the lever 1 with a space d0 being inserted between the top of the head and the lower surface 1*d*.

Figure 2:
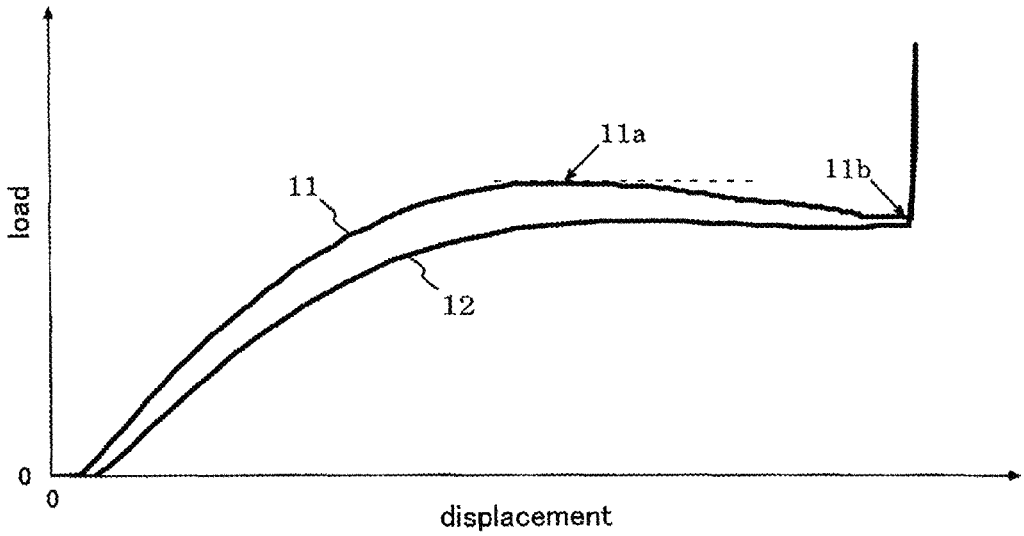
FIG. 2 is an overview of example characteristics of displacement and load of a dome-shaped rubber member.

FIG. 2 indicates an overview of example characteristics of displacement and load of the dome-shaped rubber member 5. In this figure, the vertical axis indicates the load imposed on the dome-shaped rubber member 5, while the horizontal axis indicates the amount of displacement of the top of the head of the dome-shaped rubber member 5 caused by the compression of the dome-shaped rubber member 5. When the lever 1 presses the dome-shaped rubber member 5, a reaction force whose magnitude is equal to the load imposed by the lever 1 is exerted on the lever 1 as a reaction. The reaction force is conveyed to a player of the electronic keyboard instrument. A characteristic curve 11 of FIG. 2 indicates characteristics of the reaction force exerted when the dome-shaped rubber member 5 is pressed, while a characteristic curve 12 indicates characteristics of the reaction force exerted when the dome-shaped rubber member 5 recovers to its original shape. Therefore, the dome-shaped rubber member 5 exhibits hysteresis.

As indicated by the characteristic curve 11 indicative of the reaction force exerted when the dome-shaped rubber member 5 is pressed, the load (reaction force) is zero in an early stage of the press. Although the load (reaction force) then rises at a roughly constant positive rate of change, the rate of change gradually decreases to turn to negative at an inflection point 11*a*, followed by a slight decline of the rate of change. The characteristic curve 11 is obtained because of the bending portion 5*a* of the dome-shaped rubber member 5 being gradually buckled and deformed. Then, the bending portion 5*a* comes into contact with the bottom plate 2*a*, so that the rate of change rises sharply at an inflection point 11*b*. The dome-shaped rubber member 5 is to be used within a displacement range which does not allow the displacement to reach the inflection point 11*b*. As indicated by the characteristic curve 12 indicative of load (reaction force) exerted when the dome-shaped rubber member 5 recovers, because of the hysteresis, the loads (reaction forces) with respect to the amounts of displacement are small, compared with those indicated by the characteristic curve 11. In the end, however, the buckling deformation is eliminated, so that the dome-shaped rubber member 5 recovers to its original shape.

FIG. 1 will be explained again. Above the lever 1, a first mounting plate 2*e* is provided near the front opening 2*d* of the pedal frame 2. To the first mounting plate 2*e*, the upper limit stopper 6 is secured downward. Behind the first mounting plate 2*e* in the direction of the length of the lever 1, a second mounting plate 2*f* is provided. On the second mounting plate 2*f*, a sensor mounting circuit board 7 is mounted. On the undersurface of the sensor mounting circuit board 7, a first sensor 8 is provided. The first mounting plate 2*e* and the second mounting plate 2*f* are provided to run between the right and left side plates 2*c* of the pedal frame 2, for example. In the initial state of the lever 1, the upper limit stopper 6 is in contact with the upper surface 1*b* of the lever 1, whereas the first sensor 8 is placed to face the upper surface 1*b* of the lever 1 with a space dl being inserted between the first sensor 8 and the upper surface 1*b*.

The first sensor 8 outputs the amount of depression of the pedal, that is, an analog amount corresponding to the amount of stroke of the lever 1. The first sensor 8 is a reflective sensor having a light emitting portion and a light receiving portion, for example. The light emitted from the light emitting portion is reflected off the upper surface 1*b* of the lever 1, so that the light receiving portion receives the reflected light. Because the amount of received light varies according to the space dl, the first sensor 8 can output the analog amount corresponding to the amount of stroke of the lever 1.

The first sensor 8 for obtaining the amount of stroke of the lever 1 may be replaced with a variable resistor connected to the lever 1 to turn in synchronization with the lever 1. According to the stroke of the lever 1, the resistance varies. Alternatively, the first sensor 8 may be replaced with a sensor which obtains the amount of stroke of the lever 1 by providing the lever 1 or a member which turns in synchronization with the lever 1 with a magnetically or optically calibrated plate so that the sensor provided on the pedal frame 2 can read the calibrated plate to obtain the amount of stroke of the lever 1. Furthermore, the first sensor 8 may be replaced with a rubber switch which includes a plurality of switches that turn on step by step. The rubber switch allows stepwise detection of the amount of stroke by sequentially making short-circuits between a plurality of moving contacts and their respective fixed contacts in accordance with the amount of stroke of the lever 1.

Although the above-described first sensor 8 which detects the amount of stroke of the lever 1 will suffice, this embodiment also employs the second sensor 9. The second sensor 9 detects the amount of displacement of the dome-shaped rubber member 5 after the contact of the top (the screw 5*e*) of the head of the dome-shaped rubber member 5 with the lever 1 to obtain the amount of displacement of the dome-shaped rubber member 5. In the shown example, the second sensor 9 is situated in the inner space 5*c* of the dome-shaped rubber member 5 so that the second sensor 9 can be placed on the top surface of the bottom plate 2*a*.

The second sensor 9 is a reflective sensor having a light emitting portion and a light receiving portion, for example. The light emitted from the light emitting portion is reflected off the inner wall surface of the inner space 5*c* of the dome-shaped rubber member 5, so that the light receiving portion receives the reflected light. Because the amount of received light varies according to the displacement of the dome-shaped rubber member 5, the second sensor 9 can detects the amount of displacement of the dome-shaped rubber member 5 after the contact of the top (the screw 5*e*) of the dome-shaped rubber member 5 with the lever 1. The second sensor 9 may be served by a conductive rubber or a piezoelectric sensor affixed to the top of the head (the screw 5*e*). In this case, after the lower surface 1*d* of the lever 1 comes into contact with the top of the head (the screw 5*e*), the second sensor 9 detects the load exerted on the top of the head (the screw 5*e*) in accordance with the resistance value of the conductive rubber or the voltage generated by the piezoelectric sensor.

The amount of stroke of the lever 1 detected by the first sensor 8, and the amount of displacement of the dome-shaped rubber member 5 or the load exerted on the dome-shaped rubber member 5 detected by the second sensor 9 are used in order to add, in accordance with the detected amount of stroke and the amount of displacement or the load, a damper pedal effect or a shift pedal effect to a musical tone generated by the electronic musical instrument. Details will be described later with reference to FIG. 4.

Figure 3A:
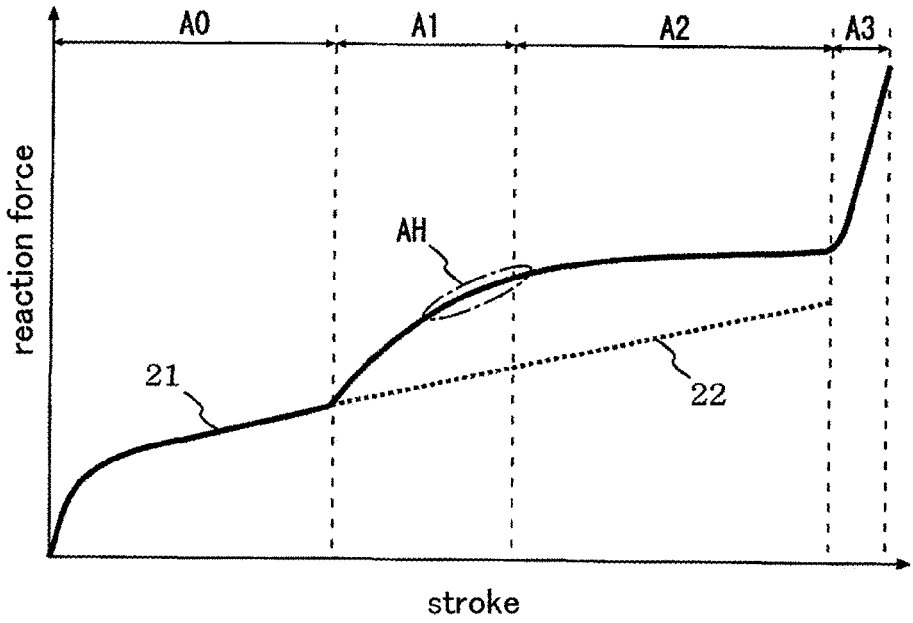
FIG. 3A is an overview of a typical example of characteristics of reaction force exerted by a lever of the embodiment indicated in FIG. 1.
Figure 3B:
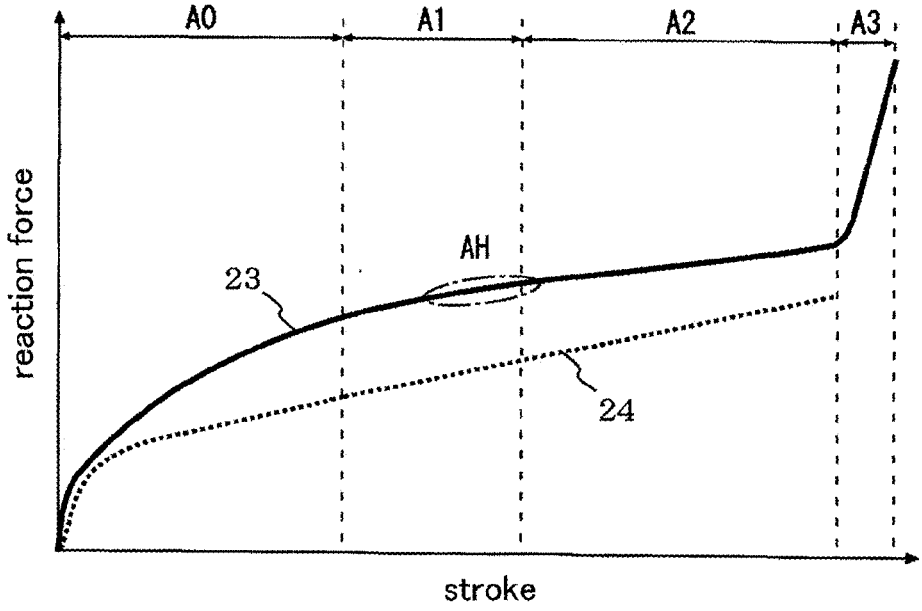
FIG. 3B is an overview of a modified example of characteristics of reaction force indicated in FIG. 3A.

FIG. 3A and FIG. 3B indicate overviews of characteristics of reaction force exerted by the lever 1 of the embodiment indicated in FIG. 1. FIG. 3A indicates a typical example of the characteristics of reaction force, while FIG. 3B which will be described later indicates a modified example of the characteristics of reaction force. In these figures, the horizontal axis indicates the amount of stroke of the lever 1, while the vertical axis indicates the reaction force exerted by the lever 1 on a player. A characteristic curve 21 indicates characteristics of the lever 1. In FIG. 3A, the characteristic curve 21 is separated into four areas so that the four areas will correspond to areas A0 to A3 of a characteristic curve of a grand piano indicated in FIG. 5, respectively. In the area A0 where the stroke of the lever 1 is small, the reaction force obtained only by elastic force of the coil spring 4 acts. When the lever 1 which is in the initial state (in the state where the lever 1 is not being depressed) indicated in FIG. 1 is depressed by the player, the lever 1 starts turning about the fulcrum 1*c*. At the time of the start of the turn, although the rate of change in reaction force (increment value of reaction force divided by increment value of the amount of stroke) temporarily rises because of an initial reaction force, the reaction force increases at a roughly constant rate of change because of the elastic force of the coil spring 4.

When the player depresses the operating portion 1*a* of the lever 1 further to allow the lower surface 1*d* of the lever 1 to come into contact with the top of the head (the screw 5*e*) during the increase in the amount of stroke, the characteristic curve enters the area A1 of FIG. 3A. In the area A1, the deformation of the bending portion 5*a* of the dome-shaped rubber member 5 starts, so that the rate of change in reaction force indicated by the characteristic curve 21 grows, for the resultant of the elastic force of the coil spring 4 and the elastic force of the dome-shaped rubber member 5 is applied to the lever 1. In FIG. 3A, a broken line 22 is a characteristic curve indicative of the reaction force exerted by the coil spring 4 in the areas A1 and later. The amount of stroke which allows entering the area A1 is determined according to the space d0 indicated in FIG. 1. The space d0 is adjustable by changing the thickness of the spacer 5*f* fit into the screw 5*e*, for example.

When the operating portion 1*a* of the lever 1 is depressed further, the inclination of the characteristic curve 11 of FIG. 2 indicative of the displacement and the load of the dome-shaped rubber member 5 gradually reduces. As indicated by the characteristic curve 21 of FIG. 3A, therefore, the rate of change in reaction force gradually decreases to enter the area A2. When the player depresses the operating portion 1*a* of the lever 1 further, the rate of change indicated by the characteristic curve 21 decreases further. When the lower surface 1*d* of the lever 1 comes into contact with the lower limit stopper 3, the rate of change sharply increases positively to enter the area A3.

Figure 5:
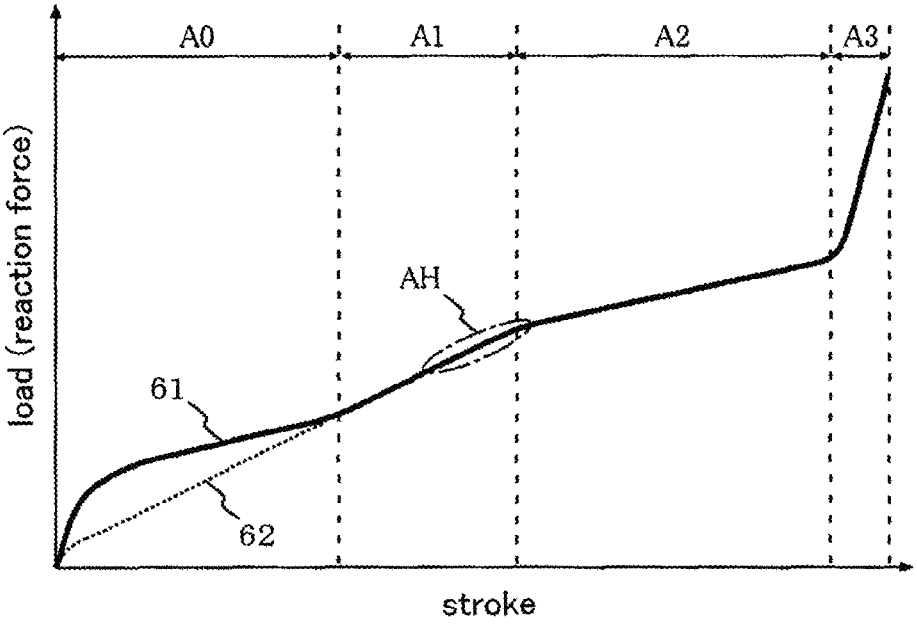
FIG. 5 is an overview of characteristics of reaction force exerted by a lever of a grand piano.

As for the grand piano explained with reference to FIG. 5, an area AH ranging from the latter half of the area A1 to the area A2 is a half pedal area. As for the electronic musical instrument as well, the half pedal area AH indicated in FIG. 3A is realized in order to allow the control of musical tones by subtle control of the depression of the lever 1. When the characteristic curve 21 indicative of reaction force indicated in FIG. 3A is compared with the characteristic curve 61 indicative of the reaction force of the grand piano indicated in FIG. 5, the characteristic curve 21 demonstrates a tendency to reduce the rate of change in reaction force from the area A1 to the area A2, but the reduction is vague. As a result, this embodiment is not necessarily able to realize the same touch as the grand piano indicated in FIG. 5. As compared with the conventional damper pedal which fails to vary the rate of change in reaction force due to the urging only by one spring, however, this embodiment offers easy recognition of the half pedal area AH to the player.

Referring to FIG. 3B, the modified example of the characteristics of reaction force will be described. A characteristic curve 23 indicative of reaction force of the lever 1 is separated into four areas so that the four areas will correspond to the areas A0 to A3 of the characteristic curve of the grand piano indicated in FIG. 5, respectively. A broken line 24 is a characteristic curve indicative of the reaction force exerted by the coil spring 4. The configuration indicated in FIG. 1 is modified such that the dome-shaped rubber member 5 is made larger, for example, so that the lower surface 1*d* of the lever 1 is in contact with the top of the head (the screw 5*e*) of the dome-shaped rubber member 5 at all times (d0=0). As a result, the dome-shaped rubber member 5 is displaced from the start of the stroke of the lever 1. The modified example is designed such that the bending portion 5*a* indicated in FIG. 1 and provided for the dome-shaped rubber member 5 will not come into contact with the bottom plate 2*a* throughout the entire range of the stroke of the lever 1.

In this modified example, the reaction force of the lever 1 is produced by both the coil spring 4 and the dome-shaped rubber member 5 from the start of player's depression of the lever 1. This modified example is designed to resemble the characteristic curve 62 which has no fluctuations in the rate of change in reaction force at the boundary between the area A0 and the area A1 of FIG. 5. The modified example also has the half pedal area AH ranging from the area A1 to the area A2 to allow player's control of musical tones with the pedal.

Figure 4:
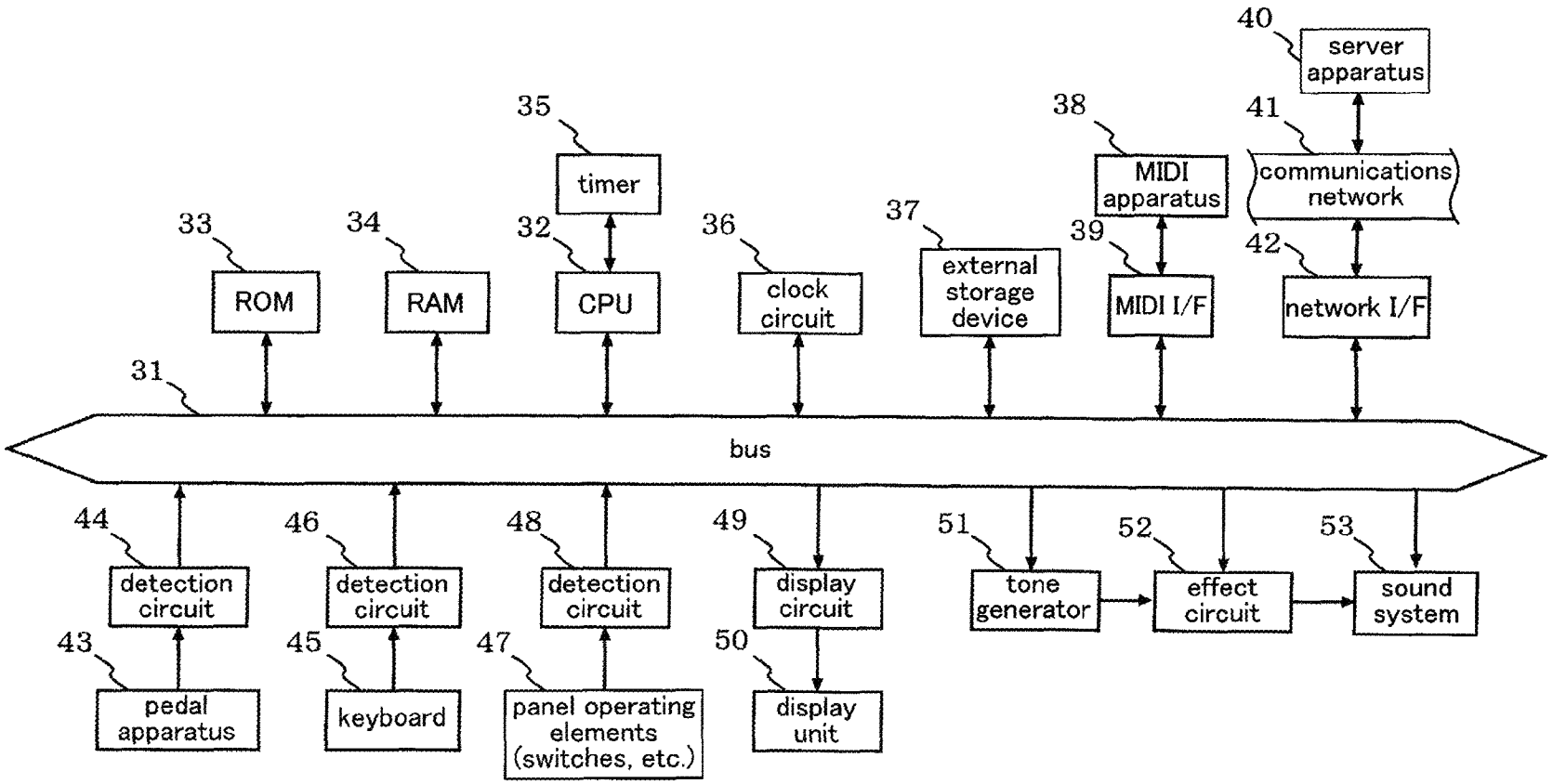
FIG. 4 is a hardware configuration indicative of an example electronic musical instrument which employs the embodiment indicated in FIG. 1.

FIG. 4 is a hardware configuration indicative of an example electronic musical instrument which employs the embodiment indicated in FIG. 1. A bus 31 connects a plurality of hardware blocks such as a CPU (Central Processing Unit) 32 with each other to allow transfer of data and programs under the control of the CPU 32. A ROM (Read Only Memory) 33, which is a flash ROM (Electrically Erasable Programmable ROM), for example, stores programs, conversion tables, set data on parameters, music data files, accompaniment data files and the like, keeping them even after the main power of the electronic keyboard instrument has been turned off. The CPU 32 is a computer which controls the entire instrument in order to allow integrated functions of the hardware blocks and integrated transfer among the respective hardware blocks by executing programs by use of working areas provided in a RAM (Random Access Memory) 34. Time interrupts are executed at interrupt timings instructed by a timer 35.

The working areas provided in the RAM 34 include a key buffer area, a pedal buffer area, a flag area, and the like. The key buffer area stores a key number, velocity of key-depression, a key event (key-on/key-off), and the like so that they are correlated with a tone-generation channel. The pedal buffer area stores the amount of stroke, a pedal event (pedal-on/pedal-off) and the like so that they are correlated with the damper pedal, shift pedal or the like.

A clock circuit 36 maintains current date and time even in a state where the power is turned off. An external storage device 37, which is an HDD (a hard magnetic disk drive), a USB (Universal Serial Bus) memory and the like, stores programs and data instead of the above-described ROM 33. The programs and data stored in the ROM 33 or the external storage device 37 can be stored in a server apparatus 40 so that the stored programs and data can be updated through a communications network 41 and a network interface 42. Furthermore, MIDI signals transferred from a MIDI apparatus 38 can be input through a MIDI interface 39 so that the electronic keyboard instrument can play music on the basis of the MIDI signals. In addition, MIDI signals output when the electronic keyboard instrument plays music can be transferred to the MIDI apparatus 38.

As performance operating elements, a pedal apparatus 43 and a keyboard 45 are indicated in the figure. Manipulations of the pedal apparatus 43 and the keyboard 45 are detected by detection circuits 44, 46, respectively, so that the detected results are output to the bus 31. The pedal apparatus 43 is the lever 1 (the damper pedal or the shift pedal) indicated in FIG. 1. The detection circuit 44 of the pedal apparatus 43 converts analog signals output from the first sensor 8 and the second sensor 9 indicated in FIG. 1 or sensors provided instead of the first and second sensors into digital values. The digital vales are transferred to the RAM 34 through the bus 31 by the CPU 32 to be temporarily stored in the pedal buffer. The digital values may be stored in the pedal buffer as data directly corresponding to the amount of stroke or a load. Alternatively, the digital values may be converted into the amount of stroke or a load by referring to a table for converting a sensor output into the amount of stroke or a table for converting a sensor output into a load before being stored in the pedal buffer.

Next, concrete examples of using the output of the first sensor 8 (stroke) and the output of the second sensor 9 (displacement, load) will be described. In any case, a musical tone will be controlled as follows: Within a range of the stroke where the pedal is depressed deeper than the half pedal area AH, it is considered that the damper pedal is in an "on" state without distinction of the amount of stroke. Within a range where the pedal is depressed shallower than the half pedal area AH, it is considered that the damper pedal is in an "off" state without distinction of the amount of stroke.

(1) The amount of stroke of the lever 1 is detected by the first sensor 8 to determine whether the detected amount of stroke falls within the half pedal area AH to control a musical tone in accordance with the amount of stroke of the lever 1 in the half pedal area AH. The second sensor 9 will not be used. Even if the characteristics of reaction force of the dome-shaped rubber member 5 have been deteriorated with time, this concrete example secures the control of a musical tone in the half pedal, the control starting at a certain amount of stroke of the lever 1.

(2) The displacement or load of the dome-shaped rubber member 5 is detected by the second sensor 9 to determine whether the detected displacement or load falls within the half pedal area AH to control the timbre of a musical tone in accordance with the displacement or load of the dome-shaped rubber member 5 in the half pedal area AH. The first sensor 8 will not be used. In this concrete example, because a musical tone is to be controlled in accordance with the displacement or load of the dome-shaped rubber member 5 from the timing where the dome-shaped rubber member 5 comes into contact with the lever 1, the characteristics of reaction force always coincide with characteristics of control of a musical tone regardless of individual differences in the dome-shaped rubber member 5.

(3) The first sensor 8 detects the amount of stroke of the lever 1. The second sensor 9 detects the displacement or load of the dome-shaped rubber member 5 to detect the timing where the dome-shaped rubber member 5 comes into contact with the lever 1. The amount of stroke of the lever 1 at the timing where the dome-shaped rubber member 5 comes into contact with the lever 1 is regarded as the start position (the lower limit position) of the half pedal area AH, while the end position (the upper limit position) of the half pedal area AH is determined according to the amount of stroke of the lever 1. In this concrete example, a musical tone is to be controlled in accordance with the amount of stroke in the half pedal area AH. Considering the individual differences in the dome-shaped rubber member 5 and aging of the dome-shaped rubber member 5, by this concrete example, musical tones can be controlled.

Panel operating elements 47 include switches for allowing the player to select a mode and to set control parameters, and knobs for allowing the player to variously control set values of tone volume level and the like. The manipulations of the panel operating elements 47 are detected by a detection circuit 48 to be output to the bus 31. A display circuit 49 controls a display unit 50 configured by a liquid crystal display, LEDs, indicators and the like, transferring display image data and illumination control data in order to allow the player to input various settings.

A tone generator 51, which is a tone generating LSI (Large Scale Integrated Circuit) in general, inputs performance data or tone generation parameters generated on the basis of performance data, generates musical tone waveform signals in accordance with the input data and parameters, and then outputs the generated signals to an effect circuit 52. The effect circuit 52 adds effects such as reverb to the musical tone waveform signals, and then outputs the signals to a sound system 53. The sound system 53 adjusts the tone volume of the musical tone signals, amplifies the musical tone signals, and then outputs the amplified signals to speakers, headphones and the like.

The CPU 32 realizes the capability of controlling musical tones by executing computer programs. The CPU 32 outputs tone generation parameters generated on the basis of timbre and the like specified by use of the panel operating elements 47 to the tone generator 51. The CPU 32 transfers an instruction for generating a musical tone, an instruction for stopping generation of a musical tone, a velocity of key-depression and the amount of stroke of the lever 1 to the tone generator 51. The tone generator 51 inputs a key-on event (an instruction for generating a musical tone) of a key, starts generation of a musical tone signal of a tone pitch assigned to the key, inputs a key-off event (an instruction for stopping generation of the musical tone) of the key, and then starts processing for stopping the generation of the musical tone. The tone generator 51 and the effect circuit 52 add a damper effect to a musical tone in accordance with the outputs from the first sensor 8, the second sensor 9 indicated in FIG. 1 or the sensors provided instead of the first and second sensors, and control the reverberation of a generated musical tone (acoustic effect). In the half pedal area AH, the tone generator and the effect circuit subtly change musical tone elements such as timber, reverberation (acoustic effect) of a generated musical tone in accordance with the player's manipulation of the pedal.

There are various known methods of controlling the timbre in a state where the damper pedal is in an "on" state and in the half pedal area AH. A concrete example of such methods will now be described briefly. The tone generator 51 stores, in a musical tone waveform data memory (included in the tone generator 51, for example), tone generation waveform data of a state where the damper pedal is in an "off" state (normal depression of a key) as well as tone generation waveform data of resonant tones in a manner in which both of the two kinds of tone generation waveform data are provided for each tone pitch. The resonant tones are equivalent to musical tones generated by a grand piano by allowing strings which can freely vibrate because of the dampers being away from the strings to vibrate sympathetically with musical tones which are being generated.

During an "on" state of the damper pedal, if a musical tone of a tone pitch is being generated, the musical tone is controlled so that the decay rate of the tone volume level of the musical tone will be milder than that of the tone volume level of the musical tone generated during an "off" state of the damper pedal. Concurrently with the control of the decay rate, a resonant tone which is to be added to the musical tone which is being generated is generated. In the half pedal area, the respective decay rates of the musical tone of the tone pitch which is being generated and the resonant tone are controlled in accordance with the amount of stroke. The amount of decay of the tone volume level decreases with an increase in the amount of stroke.

In the half pedal area, in the above-described explanation, the amount of decay of a musical tone is controlled in accordance with the amount of stroke without changing the musical tone waveform data. Instead of the above-described explanation, however, the musical tone waveform data may be changed in accordance with the amount of stroke in the half pedal area. The above-described explanation is about the control of musical tones by the damper pedal. For control of musical tones by a shift pedal, however, plural kinds of tone generation waveform data are used in order to generate a musical tone of a tone pitch. In an "on" state of the shift pedal, more specifically, tone generation waveform data for "on" state of the shift pedal (for softened tone) is used to control the musical tone.

Figure 6:
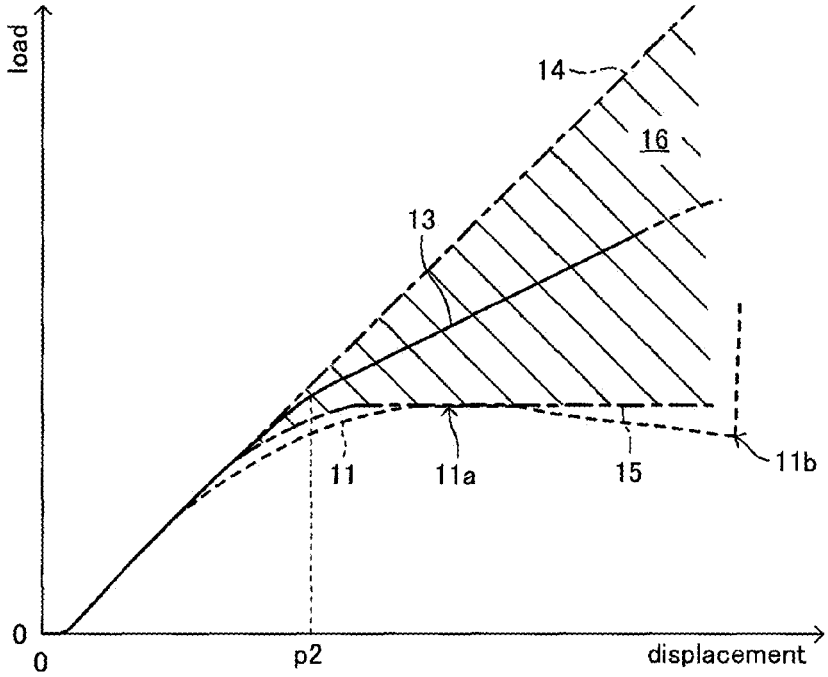
FIG. 6 is an overview of the other example characteristics of displacement and load of the dome-shaped rubber member.
Figure 7:
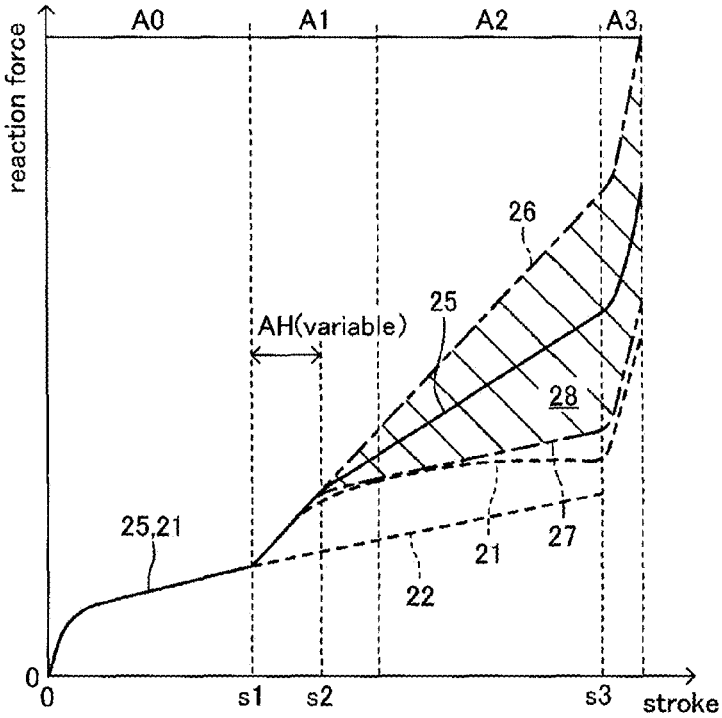
FIG. 7 is an overview of the other modified example of characteristics of reaction force indicated in FIG. 3A.

Referring to FIG. 6 and FIG. 7, the other modified example of characteristics of reaction force exerted by the lever 1 will now be described. FIG. 6 is an overview of the other example of characteristics of displacement and load of the dome-shaped rubber member 5. In this figure, the characteristic curve 11 is the same curve as the one indicated in FIG. 2. A characteristic curve 13 indicates characteristics of the reaction force exerted during a press of the dome-shaped rubber member 5. Characteristics of the reaction force exerted when the dome-shaped rubber member 5 recovers are not shown. The load (reaction force) is zero in an early stage of the press. Although the load (reaction force) then rises at a roughly constant positive rate of change (=increment value of load divided by increment value of displacement), the rate of change gradually decreases, followed by increases in the load at a roughly constant small positive rate of change. When the bending portion 5*a* then comes into contact with the bottom plate 2*a*, the rate of change rises sharply. The characteristic curve 13 is obtained because of the bending portion 5*a* of the dome-shaped rubber member 5 being deformed to sink. The dome-shaped rubber member 5 is to be used within a displacement range which does not allow the bending portion 5*a* to come into contact with the bottom plate 2*a*. During the recovery of the dome-shaped rubber member 5, the loads (reaction forces) with respect to the amounts of displacement are small because of hysteresis, compared with those exerted during the press of the dome-shaped rubber member 5. In the end, however, the buckling deformation is eliminated, so that the dome-shaped rubber member 5 recovers to its original shape.

FIG. 7 is an overview indicative of characteristics of reaction force of the lever 1 exhibited in a case where the dome-shaped rubber member 5 having the characteristics indicated by the characteristic curve 13 of FIG. 6 is used. In FIG. 7, the characteristic curve 21 of the lever 1, the characteristic curve 22 indicative of the reaction force exerted by the coil spring 4, and the areas A0, A1, A2, A3 are the same as those indicated in FIG. 3A. A characteristic curve 25 is a curve indicative of the reaction force exerted during a depression of the lever 1. On a depression of the lever 1, although the rate of change in reaction force of the lever 1 (increment value of reaction force divided by increment value of the amount of stroke) temporarily rises because of an initial reaction force, the reaction force increases at a roughly constant rate of change in the area A0 because of the coil spring 4. In the area A0, the characteristic curve 25 coincides with the characteristic curve 21. Then, the rate of change in reaction force of the lever 1 temporarily rises at some point in the stroke (at stroke s1 which is a boundary between the area A0 and the area A1). The temporal rise is obtained by the dome-shaped rubber member 5 coming into contact with the lever 1 to be coupled to the lever 1.

At some point in the rest of the stroke, the rate of change in reaction force of the lever 1 starts decreasing, followed by the rate of change of a roughly constant small positive value. By the contact of the lever 1 with the lower limit stopper 3 (at stroke s3 which is a boundary between the area A2 and the area A3), the rate of change in reaction force of the lever 1 rises sharply.

The pedal apparatus having the lever 1 of the characteristics indicated by the characteristic curve 25 realizes stepwise changes which are to be perceived by the player: the first stage at which the rate of change in reaction force of the lever increases at some point in the stroke of the lever 1, and the second stage at which the rate of change in reaction force of the lever 1 decreases after the first step. Although there are two stages, a point to enter the second stage is not clear. The point can be defined as stroke s2 where the rate of change in reaction force indicated by the characteristic curve 25 decreases most significantly (in other words, second-order differentiation of reaction force is a minimum). It is preferable that the amount of stepwise change in reaction force ranging from the first stage to the second stage is approximately the same as the initial reaction force exerted at the start of a depression of the lever 1. More specifically, it is preferable that the amount of stepwise change is between or equal to half the initial reaction force and double the initial reaction force. A point p2 indicated in FIG. 6 represents the amount of displacement of the dome-shaped rubber member 5 corresponding to the stroke value s2. Because the rate of change in reaction force of the lever 1 decreases in the second stage, the pedal apparatus is able to reduce the increase in reaction force exerted when the lever 1 eventually comes into contact with the lower limit stopper 3 (reaction force exerted at the maximum stroke).

In a case where the characteristic curve of the lever 1 falls within an area defined by a hypothetical line 26 (excluding the hypothetical line 26), the two-stage changes are relatively clear. The hypothetical line 26 indicates that if the characteristic curve of the lever 1 falls within the area defined by the hypothetical line 26, the characteristic curve keeps the rate of change indicated at the stroke s1 to increase the reaction force at a constant positive rate of change. A corresponding characteristic curve of the dome-shaped rubber member 5 falls within an area defined by a hypothetical line 14 (excluding the hypothetical line 14) indicated in FIG. 6. The hypothetical line 14 exhibits characteristics that the rate of change obtained after the early stage of the press indicated by the characteristic curve 11 is maintained to increase the load at a constant positive rate of change.

In FIG. 7, if the decrease in the rate of change in reaction force is small, it is difficult for the player to perceive the transfer to the second stage. It is preferable, therefore, that after the decrease of the rate of change in reaction force at some point in the stroke, the rate of change in reaction force is smaller than or equal to half the sum of the rate of change indicated by the hypothetical line 26 and the rate of change indicated by a hypothetical line 27. The hypothetical line 27 exhibits characteristics that the rate of change in reaction force decreases to be equal to the rate of change indicated by the characteristic curve 22 (the characteristic curve indicative of the reaction force exerted by the coil spring 4).

The rate of change of a corresponding characteristic curve of the dome-shaped rubber member 5 is smaller than or equal to half the rate of change indicated by the hypothetical line 14, and larger than or equal to the rate of change indicated by a hypothetical line 15. The hypothetical line 15 exhibits characteristics that although the load (reaction force), which starts at "0" at the early stage of the press, maintains a positive rate of change indicated by the characteristic curve 13 after the early stage to be increased, the rate of change gradually decrease to "0".

If the dome-shaped rubber member 5 is designed, for example, such that the wall thickness of a tube portion extending downward from the shoulders of the bending portion 5*a* increases with increasing proximity to the base portion 5*b*, the decrease in the rate of change in load arising at some point in the displacement of the dome-shaped rubber member 5 is small, resulting in characteristics approaching the hypothetical line 14. On the other hand, if the dome-shaped rubber member 5 is designed such that the wall thickness of the tube portion extending downward from the shoulders of the bending portion 5*a* is uniform with a uniform diameter of the tube, the decrease in the rate of change arising at some point in the displacement is great. As described above, the dome-shaped rubber member 5 is not limited to the shape indicated in FIG. 1, but may be shaped like a semi-round, semi-oval round, frustum of a cone, or circular cylinder.

An advantage in using the dome-shaped rubber member 5 having the characteristics passing through a hatch area 16 which does not reach the hypothetical line 14 (excluding the hypothetical line 14) and is more than or equal to the hypothetical line 15 (including the hypothetical line 15) in FIG. 6 will now be explained. By such characteristics, the rate of change in reaction force with respect to the displacement of the dome-shaped rubber member 5 decreases without turning negative at any point in the displacement. The dome-shaped rubber member 5 having such characteristics increases durability, also stabilizing deformation of the dome-shaped rubber member 5.

The half pedal area AH has been already explained with reference to FIG. 3. Referring to FIG. 7, however, the half pedal area AH will be described again. In the explanation referring to FIG. 3A and FIG. 3B, the area AH indicated in FIG. 3A and FIG. 3B is defined as a half pedal area in consideration of the reaction force characteristics of the acoustic piano indicated in FIG. 5. However, the half pedal area AH (the lowest stroke value and the highest stroke value) may be defined freely. The half pedal area AH may be user-programmable through user's selection.

In a case where the lever 1 is designed such that the lowest value of the half pedal area AH is situated at or near the above-described stroke s1 while the highest value is situated at or near the above-described stroke s2, the lever 1 enables half pedal control which realizes the two-stage changes in the rate of change in reaction force of the lever 1. By employing the lever 1 designed as above, more specifically, the stepwise changes in the rate of change in reaction force of the lever 1 coincide with changes in musical tones controlled by the lever 1. In this case, since the rate of decrease in the rate of change in reaction force does not vary significantly in the neighborhood of the stroke s2, a possible area in which the highest value can fall is wide.

The modified example of characteristics of reaction force of the lever 1 indicated in FIG. 3B is obtained by the lever 1 of FIG. 1 designed such that the lever 1 is in contact with the dome-shaped rubber member 5 at all times to be coupled to the dome-shaped rubber member 5. In the case of this modified example as well where the rate of change in load with respect to the displacement of the dome-shaped rubber member 5 decreases without turning negative at any point in the displacement, the player can perceive a stepwise change during the depression of the lever 1. In addition, since the lever 1 of the modified example is designed such that the rate of change in reaction force decreases before the lever 1 comes into contact with the lower limit stopper 3, an increase in the reaction force at the maximum stroke can be reduced. Because the rate of change in load will not turn negative, furthermore, the dome-shaped rubber member 5 increases durability, also stabilizing the deformation of the dome-shaped rubber member 5.

Figure 8A:
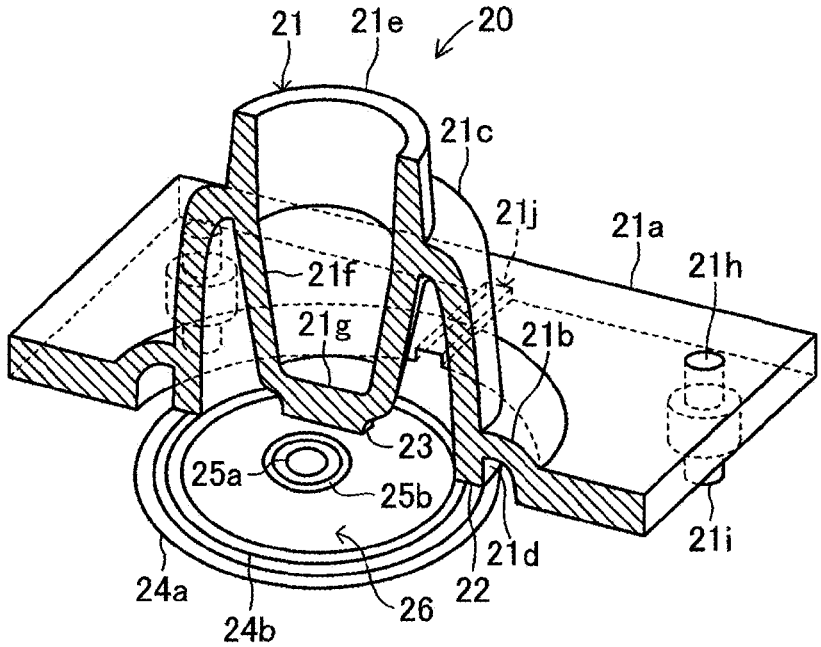
FIG. 8A is a cross sectional view of a modified example of the dome-shaped rubber member indicated in FIG. 1.

In the embodiment indicated in FIG. 1, the second sensor 9 is a reflective sensor. However, the second sensor 9 may be a switch which turns on/off according to the displacement of the dome-shaped rubber member 5. In this case, as indicated in FIG. 8A, the dome-shaped rubber member 5 may be replaced with a dome-shaped rubber member 20 having two switches which turn on/off according to the displacement. The dome-shaped rubber member 20 has a first switch SWa (a first moving contact 22, a first fixed contact pair 24*a*, 24*b*) for detecting the first displacement, and a second SWb (a second moving contact 23, a second fixed contact pair 25*a*, 25*b*) for detecting the second displacement.

The dome-shaped rubber member 20 is formed of an elastic rubber member 21, the first moving contact 22 and the second moving contact 23 which have electrical conductivity, and a printed wiring board 26 having the first fixed contact pair 24*a*, 24*b* and the second fixed contact pair 25*a*, 25*b*. The rubber member 21 has a base portion 21*a* installed on the printed wiring board 26. The rubber member 21 also has a first outer dome 21*b* which extends upward from the base portion 21*a* to swell like a ring with its shoulder part bending toward the center of the ring. The rubber member 21 also has a second outer dome 21*c* which is integrally coupled to the center side of the top end of the first outer dome 21*b* to extend upward to swell like a ring with its shoulder bending toward the center. A hem of the second outer dome 21*c* extends from a part where the second outer dome 21*c* is coupled to the first outer dome 21*b* toward a lower part of the first outer dome 21*b*, so that the lower end of the second outer dome 21*c* serves as a first moving portion 21*d*. On the undersurface of the first moving portion 21*d*, the conductive first moving contact 22 is provided. The first moving contact 22 faces the first fixed contact pair 24*a*, 24*b* with a first certain distance away.

The rubber member 21 has a cylindrical driven portion 21*e* which is coupled to the center side of the top end of the second outer dome 21*c* to extend perpendicularly upward. The driven portion 21*e*, which serves as a head portion of the dome-shaped rubber member 20, faces the lower surface 1*d* of the lever 1. The driven portion 21*e* is not necessarily shaped like a hollow cylinder, but may be shaped like a solid cylinder or a rectangular flat plate. The rubber member 21 also has an inner dome 21*f* which is integrally coupled to the center side of the top end of the second outer dome 21*c* to extend downward to swell. A bottom portion of the inner dome 21*f* serves as a second moving portion 21*g*. On the undersurface of the second moving portion 21*g*, the second moving contact 23 is provided. The second moving contact 23 faces the second fixed contact pair 25*a*, 25*b* provided on the printed wiring board 26 with a second certain distance away.

The base portion 21*a*, which is shaped like a rectangular plane, has holes 21*h* situated at four peripheral locations placed on the top surface of the base portion 21*a*. From the undersurface of the base portion 21*a* through respective centers of the holes 21*h*, leg portions 21*i* protrude, respectively. The leg portions 21*i* are fit into penetrating holes (not shown) provided on the printed wiring board 26 and the bottom plate 2*a* of the pedal frame, so that the base portion 21*a* is installed on the printed wiring board 26. There is space between the rubber member 21 and the printed wiring board 26. On a part of the bottom surface of the shown base portion 21*a* (in the shown example, in the direction orthogonal to the longitudinal direction of the lever 1), a groove 21*j* is provided to serve as an air vent.

The conductive pattern of the first fixed contact pair 24*a*, 24*b* and the second fixed contact pair 25*a*, 25*b* provided on the printed wiring board 26 is not limited to the ring-shaped pattern and the circle-shaped pattern which are indicated in the figure. The wiring pattern in which the fixed contact pairs and the other circuit components are connected is not shown. The wiring pattern is provided on the top surface of the printed wiring board 26, or on the undersurface or an inner layer of the printed wiring board through a conductor which connects between layers.

Characteristics of displacement and load of the dome-shaped rubber member 20 are similar to those of the dome-shaped rubber member 5. When the lever 1 presses the dome-shaped rubber member 20, the dome-shaped rubber member 20 starts deforming. The dome-shaped rubber member 20 is designed such that in an area where the deformation starts, the first outer dome 21*b* is compressed to bring the first fixed contact pair 24*a*, 24*b* into conduction by the first moving contact 22 to turn on the first switch SWa. By the first switch SWa, the displacement by which the rate of change in reaction force increases most significantly can be detected. The dome-shaped rubber member 20 is also designed such that when the dome-shaped rubber member 20 starts buckling to be deformed, the second fixed contact pair 25*a*, 25*b* is brought into conduction by the second moving contact 23 to turn on the second switch SWb. By the second switch SWb, the displacement by which the rate of change in reaction force decreases most significantly can be detected.

Figure 8B:
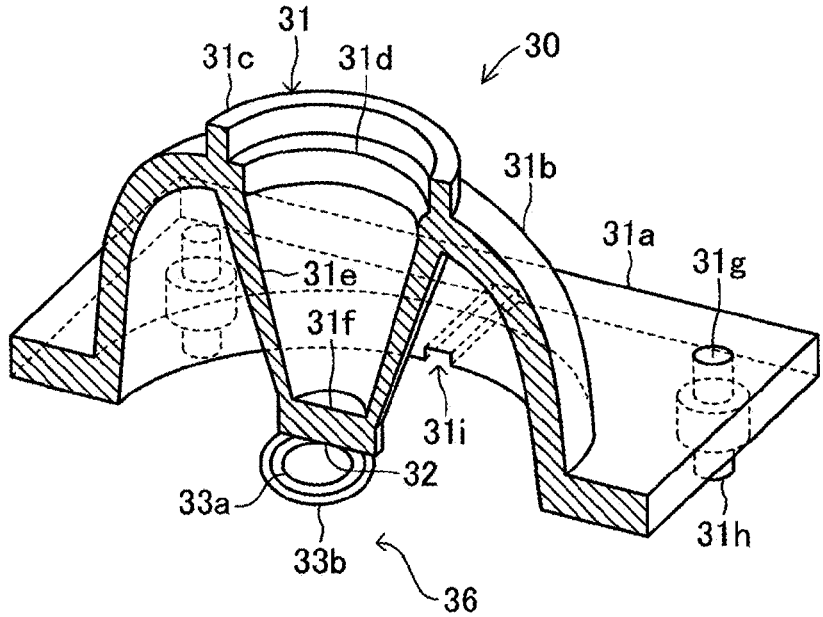
FIG. 8B is a cross sectional view of the other modified example of the dome-shaped rubber member indicated in FIG. 1.

The dome-shaped rubber member 5 may be also replaced with a dome-shaped rubber member 30 having a switch which turns on/off according to the displacement as indicated in FIG. 8B. The dome-shaped rubber member 30 also has characteristics of reaction force similar to those of the dome-shaped rubber member 5. The dome-shaped rubber member 30 has a first switch SWc (a first moving contact 32 and a first fixed contact pair 33*a*, 33*b*) for detecting a first displacement. The dome-shaped rubber member 30 is formed of an elastic rubber member 31, the conductive moving contact 32, and a printed wiring board 36 having the first fixed contact pair 33*a*, 33*b*. The rubber member 31 has a base portion 31*a* installed on the printed wiring board 36. The rubber member 31 has an outer dome 31*b* which extends upward from the base portion 31*a* to swell like a ring with its shoulder part bending toward the center of the ring. The rubber member 31 also has a cylindrical driven portion 31*c* placed on an upper end portion 31*d* of the outer dome 31*b* so that the driven portion 31*c* can be coupled to the upper end portion 31*d* slightly away from the inner edge of the upper end portion 31*d* toward the outer edge to extend perpendicularly upward. The driven portion 31*c*, which serves as a head portion of the dome-shaped rubber member 30, faces the undersurface of the lever 1. The rubber member 31 also has an inner dome 31*e* which is integrally coupled to the center side of the upper end portion 31*d* to extend downward to swell. A bottom portion of the inner dome 31*e* serves as a moving portion 31*f*. On the undersurface of the moving portion 31*f*, the conductive moving contact 32 is provided.

Similarly to the base portion 21*a* indicated in FIG. 8A, the base portion 31*a* is shaped like a rectangular plane, and has holes 31*g* placed on the top surface of the base portion 31*a*, with legs 31*h* being provided on the undersurface. On the top surface of the printed wiring board 36, the ring-shaped and circle-shaped fixed contact pair 33*a*, 33*b* is provided to face the above-described moving contact 32 with a certain distance away. The conductive pattern of the fixed contact pair is not limited to the ring-shape and the circle-shape indicated in the figure. The base portion 31*a* is installed on the printed wiring board 36 to provide space inside, with a groove 31*i* being provided as an air vent.

Characteristics of displacement and load of the dome-shaped rubber member 30 are also similar to those of the dome-shaped rubber member 5. When the lever 1 presses the dome-shaped rubber member 30, the dome-shaped rubber member 30 starts deforming. The dome-shaped rubber member 30 is designed such that in an area where the deformation starts, the outer dome 31*b* is compressed, with the inner dome 31*e* moving downward so that immediately after the start of the displacement of the dome-shaped rubber member 30, the fixed contact pair 33*a*, 33*b* can be brought into conduction by the moving contact 32 to turn on the switch SWc. By the switch SWc, the displacement by which the rate of change in reaction force increases most significantly can be detected.

The first outer dome 21*b*, the second outer dome 21*c* and the inner dome 21*f* indicated in FIG. 8A, and the outer dome 31*b* and the inner dome 31*d* indicated in FIG. 8B have rotational symmetry about their respective central axes. However, these domes do not necessarily have to have rotational symmetry. More specifically, these domes may be designed such that these domes are drawn on a plan view as an oval, a rectangle or the like as long as these domes are shaped like a dome which buckles to be deformed.

What is claimed is:

1. A pedal apparatus of an electronic musical instrument, the pedal apparatus comprising:

a lever which pivots within a predetermined stroke range by a player's depression of the lever;

a first urging element which is displaceable within the entire predetermined stroke range of the lever to produce a reaction force which increases with an increase in the displacement of the first urging element to exert the produced reaction force on the lever; and a second urging element which starts being displaced at the start or at a first predetermined point in the stroke of the lever to produce a reaction force having a characteristic that rate of change in the reaction force with respect to the displacement of the second urging element decreases in an area placed at a second predetermined point in the displacement to exert the produced reaction force on the lever.

2. The pedal apparatus of an electronic musical instrument according to claim 1, wherein the reaction force produced by the second urging element has an area in which the reaction force varies at a negative rate of change with an increase in the displacement.

3. The pedal apparatus of an electronic musical instrument according to claim 1, wherein the reaction force produced by the second urging element varies at all times at a positive rate of change with an increase in the displacement.

4. The pedal apparatus of an electronic musical instrument according to claim 1, wherein the first urging element is a metallic spring.

5. The pedal apparatus of an electronic musical instrument according to claim 1, wherein the second urging element is an elastic member whose material is rubber.

6. The pedal apparatus of an electronic musical instrument according to claim 1, wherein the second urging element produces the reaction force having the characteristic starting buckling at the second predetermined point in the displacement of the second urging element.

7. The pedal apparatus of an electronic musical instrument according to claim 6, wherein the second urging element is an elastic member shaped like a dome.

8. The pedal apparatus of an electronic musical instrument according to claim 1, the pedal apparatus further comprising:

a first switch which turns on when the rate of change in the reaction force produced by the second urging element increases most significantly during the increasing displacement of the second urging element.

9. The pedal apparatus of an electronic musical instrument according to claim 8, the pedal apparatus further comprising:

a second switch which turns on when the rate of change in the reaction force produced by the second urging element decreases most significantly during the increasing displacement of the second urging element.

10. The pedal apparatus of an electronic musical instrument according to claim 1, wherein the second urging element comes into contact with the lever at the first predetermined point in the stroke of the lever so that the second urging element can be displaced by further depression of the lever.

* * * * *